US006068268A

United States Patent [19]

Cornelius et al.

[11] Patent Number: 6,068,268

[45] Date of Patent: May 30, 2000

[54] ECCENTRIC SPACER FOR AN IN-LINE SKATE

[75] Inventors: Dirk L. Cornelius, Oakdale; Gregor Mittersinker, Minneapolis, both of Minn.

[73] Assignee: Rollerblade, Inc., Minneapolis, Minn.

[21] Appl. No.: 08/955,583

[22] Filed: Oct. 22, 1997

[51] Int. Cl.[7] ..... A63C 17/02

[52] U.S. Cl. ..... 280/11.22; 280/11.27; 280/11.19

[58] Field of Search ..... 280/11.22, 11.27, 280/11.19, 11.28, 11.23, 7.13, 841, 43

[56] References Cited

U.S. PATENT DOCUMENTS

| | | | |
|---|---|---|---|
| 212,076 | 2/1879 | Wilder | 280/43 |
| 2,145,219 | 1/1939 | Burton . | |
| 3,865,267 | 2/1975 | Morris | 215/206 |
| 5,048,848 | 9/1991 | Olson et al. | 280/11.22 |
| 5,068,956 | 12/1991 | Malewicz | 29/437 |
| 5,092,614 | 3/1992 | Malewicz | 280/11.22 |
| 5,190,301 | 3/1993 | Malewicz | 280/11.22 |
| 5,374,072 | 12/1994 | Landers | 280/11.27 |
| 5,505,470 | 4/1996 | Hoshizaki | 280/11.22 |
| 5,513,861 | 5/1996 | Monroy et al. | 280/11.22 |
| 5,716,060 | 2/1998 | Szendel | 280/11.22 |
| 5,775,707 | 7/1998 | Hu et al. | 280/11.22 |

FOREIGN PATENT DOCUMENTS

| | | |
|---|---|---|
| 0 684 055 A1 | 11/1995 | European Pat. Off. . |
| WO 95/03861 | 2/1995 | WIPO . |

*Primary Examiner*—J. J. Swann
*Assistant Examiner*—James S. McClellan
*Attorney, Agent, or Firm*—Merchant & Gould P.C.

[57] ABSTRACT

The present disclosure relates to a spacer for an in-line skate. The spacer has a main body defining an eccentric axle opening extending axially through the spacer. The spacer also includes a plurality of projections that project radially outward from the main body of the spacer.

22 Claims, 7 Drawing Sheets

ECCENTRIC SPACER FOR AN IN-LINE SKATE

FIELD OF THE INVENTION

The present invention relates generally to the field of skates. More particularly, the present invention relates to eccentric spacers for use with in-line roller skates.

BACKGROUND

In recent years, roller skating and in-line skating have become extremely popular. Many participants in these sports have developed an interest in what is known as "aggressive" or "extreme" skating. Such skating includes jumping, flipping, sliding across raised surfaces, sliding down rails, and other similar types of maneuvers.

In-line skates generally have a frame and a boot coupled to the frame. The boots of many in-line skates include hard outer shells covering portions of a soft inner liner. Typically, the frame of a skate is made of relatively rigid plastic or metal and has a platform to which the sole of a boot is connected. The frame also typically includes two spaced-apart rails that extend below the platform and define an elongated channel in which four tandemly arranged wheels can be rotatably mounted.

Features desired by aggressive skaters include a low frame stance, rockering ability, and the ability to replace the inner two wheels with wheels that are smaller than the outer two wheels while maintaining ground contact with all of the wheels. Typically, in-line skates use eccentric spacers to adjust the positioning of the various wheels. One example of an eccentric spacer is disclosed in commonly assigned U.S. Pat. No. 5,048,848.

One desirable feature of an eccentric spacer is to maintain a low frame stance with various wheel sizes. It is also desirable for eccentric spacers to be configured to permit a skater to use a larger diameter wheel in the front and the back of the skate and to use a smaller diameter wheel in the middle two wheel positions of the frame while maintaining ground contact with all of the wheels. Smaller wheels in the middle two positions are desirable because they provide a greater distance between the wheels in the middle of the frame for grinding.

It is also desirable to have a spacer that permits rockering. Rockering is a term used to indicate that the lowest circumferential points of the front most and the rear most wheels are vertically higher from the ground than the lowest circumferential points of the wheels between the front most and rear most wheels of the skate. Thus a curved plane of ground contact is formed to permit "rockering" by the skater.

The present invention provides numerous advantages over the over the prior art, as will be understood with reference to the summary, the detailed description and the drawings.

SUMMARY OF THE INVENTION

One aspect of the present invention relates to an eccentric spacer for an in-line skate. The spacer includes a main body defining an eccentric axle opening that extends axially through the spacer. The spacer also includes a plurality of projections that project radially outward from the main body of the spacer.

Another aspect of the present invention relates to an in-line skate including a boot having a sole, and a frame connected to the sole of the boot. The frame includes two spaced-apart rails that define a channel in which a plurality of tandemly arranged wheels are mounted. The tandemly arranged wheels are rotatably connected to the rails of the frame by a plurality of axles. The in-line skate also includes a plurality of eccentric spacers positionable within spacer openings defined by the rails of the frame. Each eccentric spacer includes a main body defining an eccentric axle opening for receiving one of the axles. Each eccentric spacer also includes a plurality of projections that project radially outward from the main body of each eccentric spacer.

The present invention has numerous advantages over the prior art. Prior art eccentric spacers typically provide four, or in some cases six, different axle positions. This is problematic because there are many different wheel sizes available on the market. Consequently, no single prior art eccentric spacer has the versatility and precision required to accommodate a significant number of the different wheel sizes.

The present invention relates to an eccentric spacer capable of providing a large number of different axle positions, while concurrently including structure for preventing the spacer from rotating relative to its corresponding frame. As a result, the present invention has the versatility to provide a user with a great deal of flexibility in selecting wheel sizes. By providing each eccentric spacer with a large number of different axle positions, an aggressive skater can utilize a significant number of different wheel sizes while maintaining precise spacing between the wheels and the frame of the skate, while setting a precise amount of rockering between the wheels, or while maintaining ground contact with wheels of different sizes.

The various aspects of the present invention also provide an in-line skate having eccentric spacers that are easy to mount within the frame of the skate such that the position of a given axle can be changed with minimal effort. The present invention also provides eccentric spacers that can be mounted within the frame of a skate by inserting the spacers into the frame from the outside of the frame. The various aspects of the present invention additionally provide eccentric spacers arranged and configured to prevent relative rotation between the spacers and their corresponding axles, and also to prevent relative rotation between the spacers and their corresponding frame.

A variety of additional advantages of the invention will be set forth in part in the description that follows and in part will be apparent from the description, or may be learned by practicing the invention. It is to be understood that both the foregoing general description and the following detailed description are exemplary and explanatory only and are not restrictive of the invention as claimed.

BRIEF DESCRIPTIONS OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION

Reference will now be made in detail to exemplary embodiments of the present invention which are illustrated in the accompanying drawings. Wherever possible, the same reference numbers will be used throughout the drawings to refer to the same or like parts.

Figure 1:
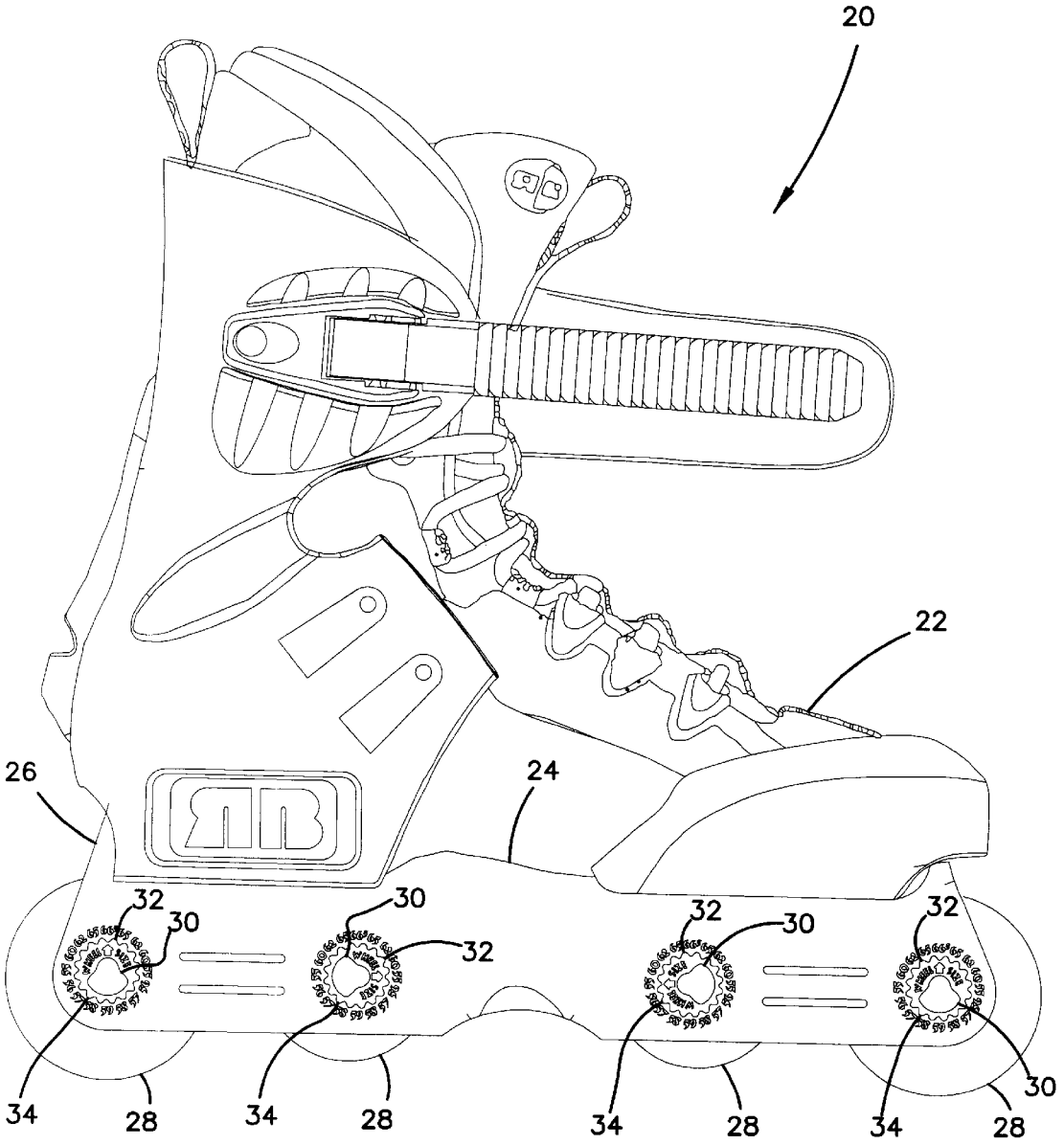
FIG. 1 is a side view of an in-line skate constructed in accordance with the principles of the present invention.
Figure 4:
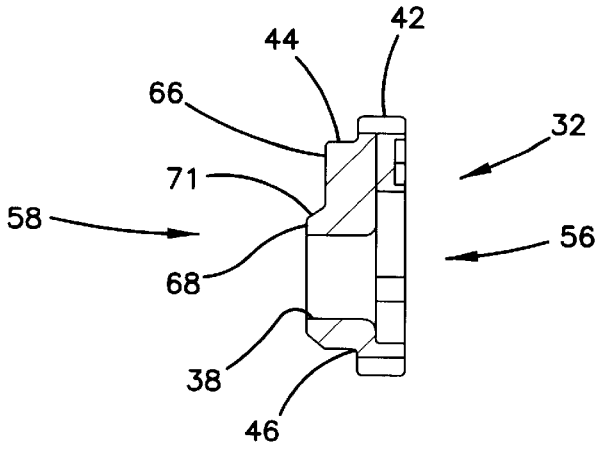
FIG. 4 is a cross-sectional view of the eccentric spacer of FIG. 2 taken along section line 4—4.
Figure 3:
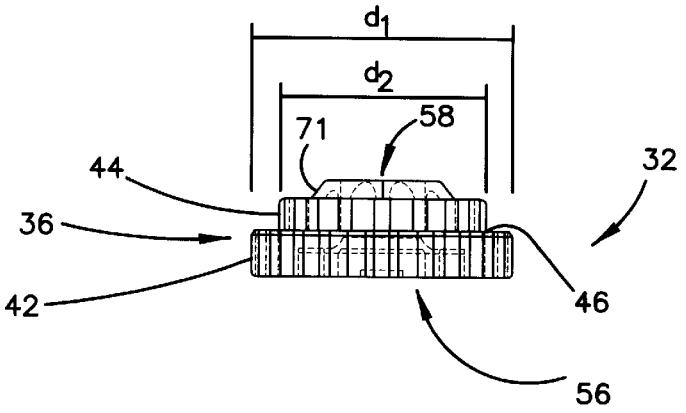
FIG. 3 is an elevational view of the eccentric spacer of FIG. 2.
Figure 2:
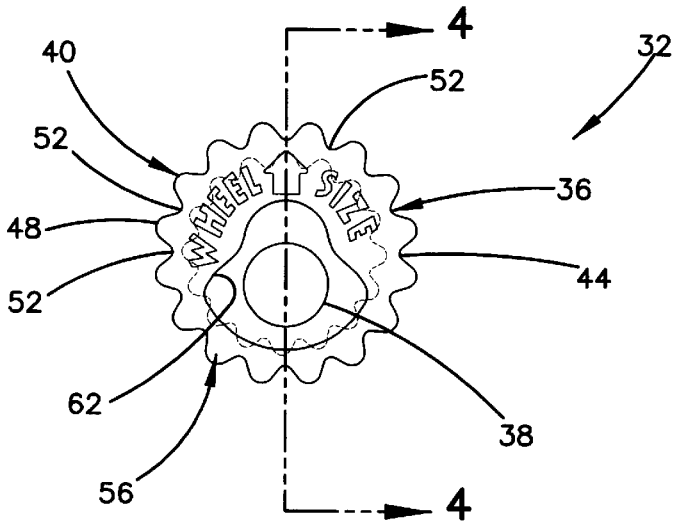
FIG. 2 is a side view of an outer side of an eccentric spacer constructed in accordance with the principles of the present invention.

FIG. 1 shows a side view of an exemplary in-line skate 20 constructed in accordance with the principles of the present invention. The illustrated skate 20 is a right skate which is used in combination with a left skate constructed in the mirror image of the right skate 20. Generally, the skate includes a boot 22 having a sole 24 to which a frame 26 is connected. A plurality of tandemly arranged wheels 28 are rotatably connected to the frame 26 by axles 30. The axles 30 are mounted within eccentric spacers 32 that are positioned within spacer openings 34 defined by the frame 26 of the skate 20. The eccentric spacers 32 allow the position of each axle 30 to be adjusted relative to the frame 26. Specifically, the eccentric spacers 32 allow each axle 30 to be positioned in any one of 16 different positions relative to the frame 26. Of course, those skilled in the art will appreciate that the eccentric spacers 32 could be designed to accommodate any number of different axle positions. Consequently, the present invention is not limited to a 16 position spacer, and includes spacers having either more or fewer positions than 16.

Referring to FIGS. 2–8, one of the eccentric spacers 32 of the skate 20 is shown in greater detail. In general, the eccentric spacer 32 includes a main body 36 defining an eccentric axle opening 38 extending axially through the spacer 32. The eccentric spacer 32 also includes a plurality of spokes, teeth or projections 40 that project radially outward from the main body 36 of the spacer 32. A preferred material for manufacturing the spacer 32 is glass filled nylon. Preferably, the spacer includes at least 6, 8, 10, 12 or 14 projections each corresponding to a different axle hole position. Most preferably, the spacer includes at least 16 projections each corresponding to a different axle hole location.

The main body 36 of the spacer 32 includes first and second portions 42 and 44 that are integrally formed and co-axially aligned with respect to one another. The first and second portions 42 and 44 are each generally circular or cylindrical and are each eccentric with respect to the eccentric axle opening 38. Additionally, the second portion 44 has a diameter $d_2$ that is smaller than a diameter $d_1$ of the first portion 42 (see FIG. 3). Consequently, a retaining shoulder 46 is formed between the first and second portions 42 and 44.

The projections 40 of the eccentric spacer 32 include first projections 48 that project radially outward from the first portion 32 of the spacer main body 36, and second projections 50 that project radially outward from the second portion 44 of the spacer main body 36. The first projections 48 are uniformly spaced about a circumference $c_1$ (see FIG. 5) of the first portion 42 of the main body 36. Similarly, the second projections 50 are uniformly spaced about a circumference $c_2$ (see FIG. 7) of the second portion 44 of the main body 36. Each of the projections 48 and 50 is generally triangular in shape with a rounded apex.

Figure 8:
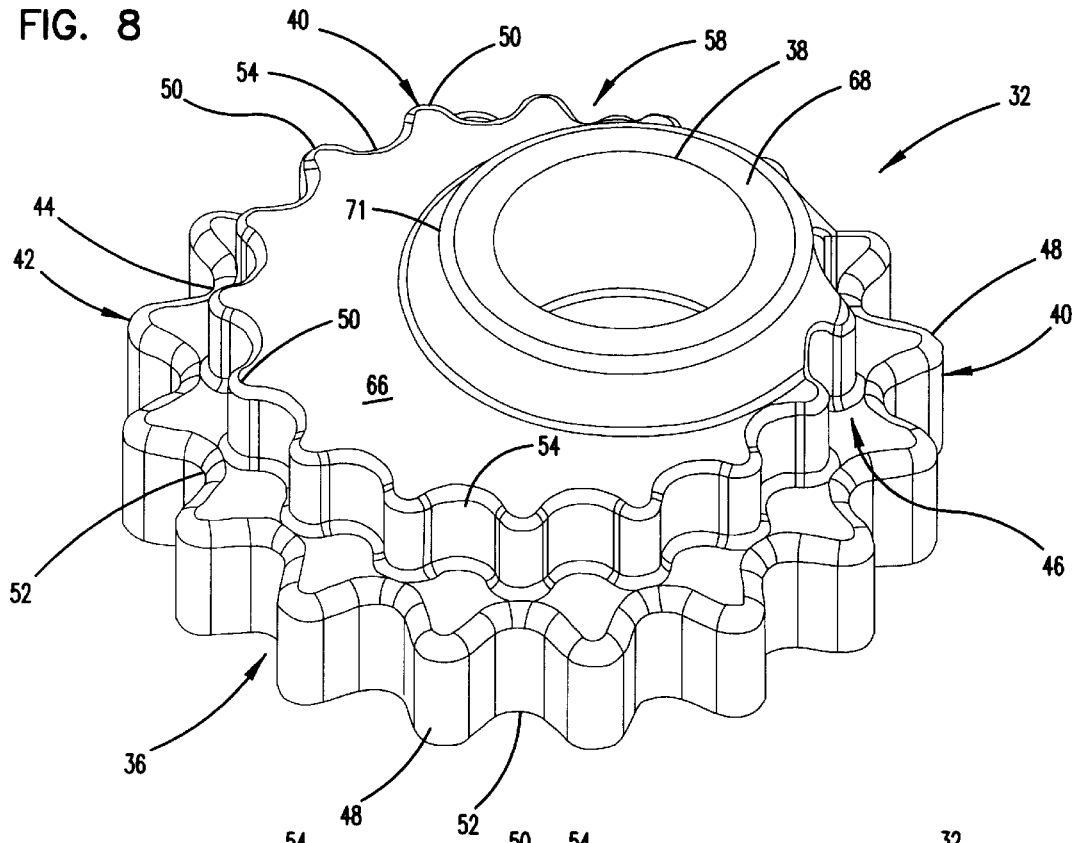
FIG. 8 is another perspective view of the inner side of the eccentric spacer of FIG. 2.
Figure 7:
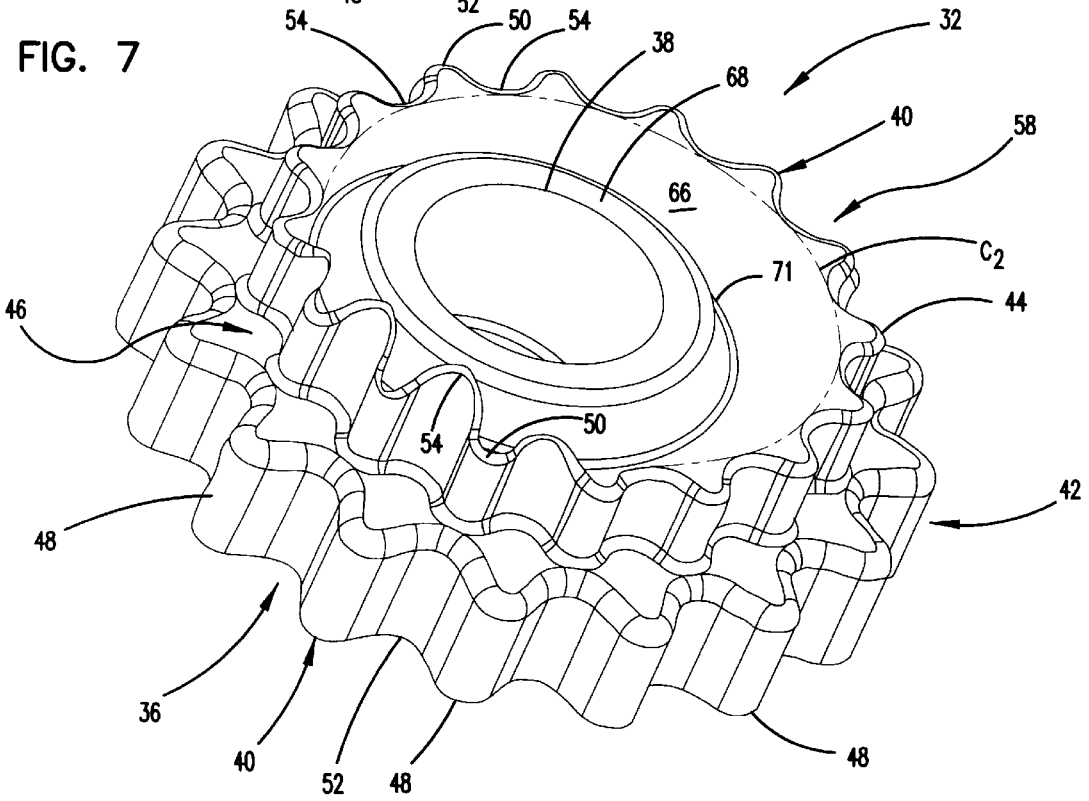
FIG. 7 is a perspective view of an inner side of the eccentric spacer of FIG. 2.

The first projections 48 are separated from one another by generally triangular first notches 52. Similarly, the second projections 50 are separated from one another by generally triangular second notches 54. As best shown in FIGS. 7 and 8, the first and second projections 48 and 50 are circumferentially staggered relative to one another such that first projections 48 are radially aligned with the second notches 54 and the second projections 50 are radially aligned with the first notches 52.

The eccentric spacer 32 includes an outer side 56 (best shown in FIGS. 5 and 6) and an inner side 58 (best shown in FIGS. 7 and 8). The outer side 56 of the eccentric spacer 32 is adapted to face away from the skate frame 26. Conversely, the inner side 58 is adapted to face inward toward the skate frame 26.

Figure 6:
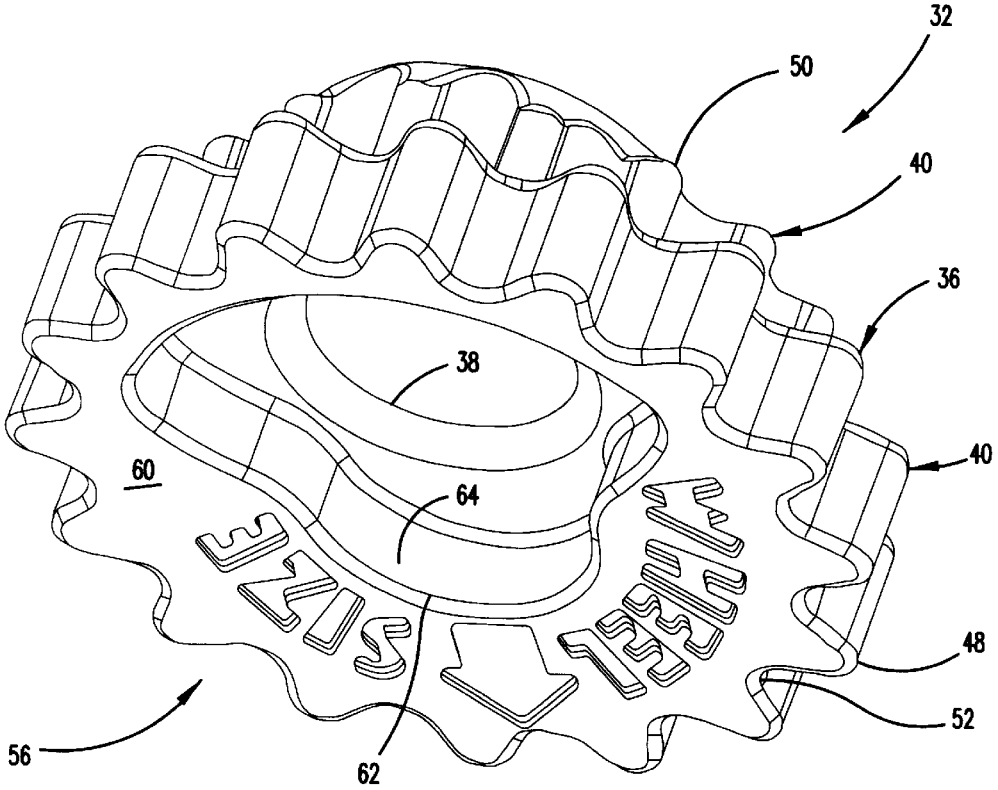
FIG. 6 is another perspective view the outer side of the eccentric spacer of FIG. 2.
Figure 5:
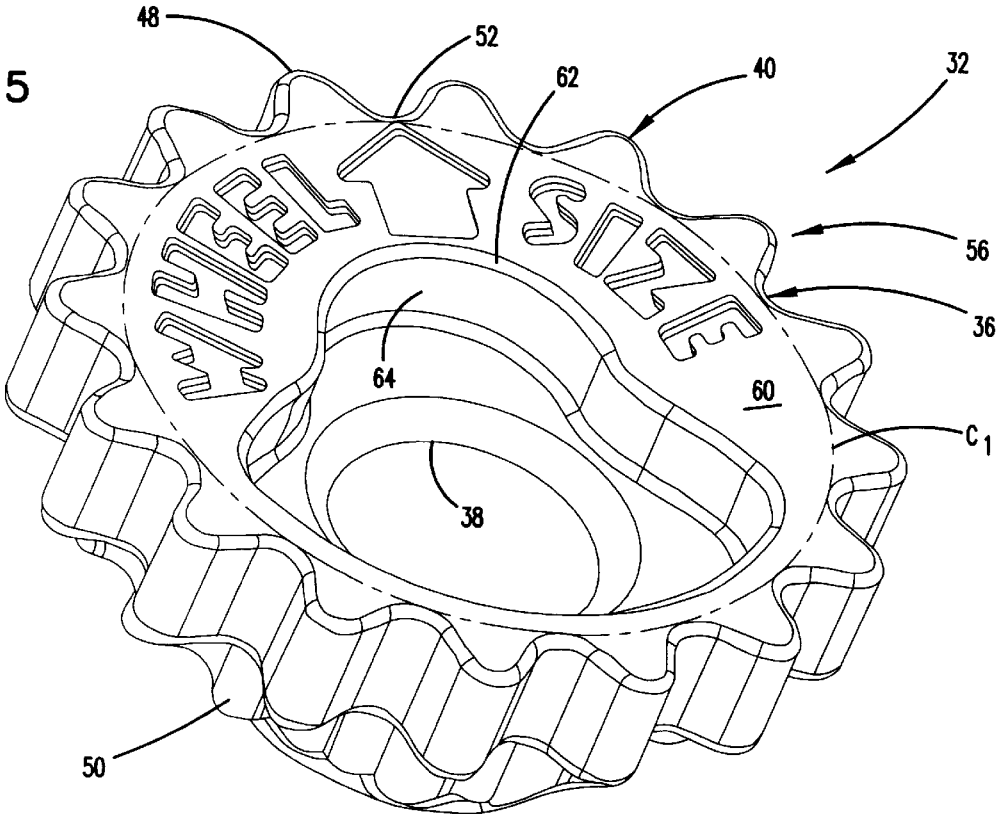
FIG. 5 is a perspective view of an outer side of the eccentric spacer of FIG. 2.

Referring now to FIGS. 5 and 6, the outer side 56 of the spacer 32 includes a generally planar outer surface 60. The outer surface 60 defines a recess 62 that surrounds the eccentric axle opening 38. The recess 62 is arranged and configured to receive and seat a head 65 (see FIG. 9) of one of the axles 30. The recess 62 is not circular in shape. Instead, the recess 62 is defined by a wall 64 having multiple portions of varying lengths and curvatures. Because the recess 62 and axle head 65 are both non-circular, the recess 62 cooperates with the axle head 65 to prevent the axle 30 from rotating relative to the eccentric spacer 32. In the preferred embodiment, both the recess 62 and the axle head 65 are generally bell-shaped.

Referring to FIGS. 7 and 8, the inner side 58 of the eccentric spacer 32 has a generally stepped configuration. A first step is formed at the retaining shoulder 46 formed between the first and second portions 42 and 44 of the spacer main body 36. A second step is formed between the second portion 44 of the main body 36, and an annular portion 71 that projects axially outward from an inner surface 66 of the second main body portion 44. The annular portion 71 is generally concentric with respect to the eccentric axle opening 38. Additionally, a majority of the annular portion 71 is chamfered such that the annular portion 71 generally forms a truncated cone having a planar inner-most surface 68 at its peak.

Figure 9:
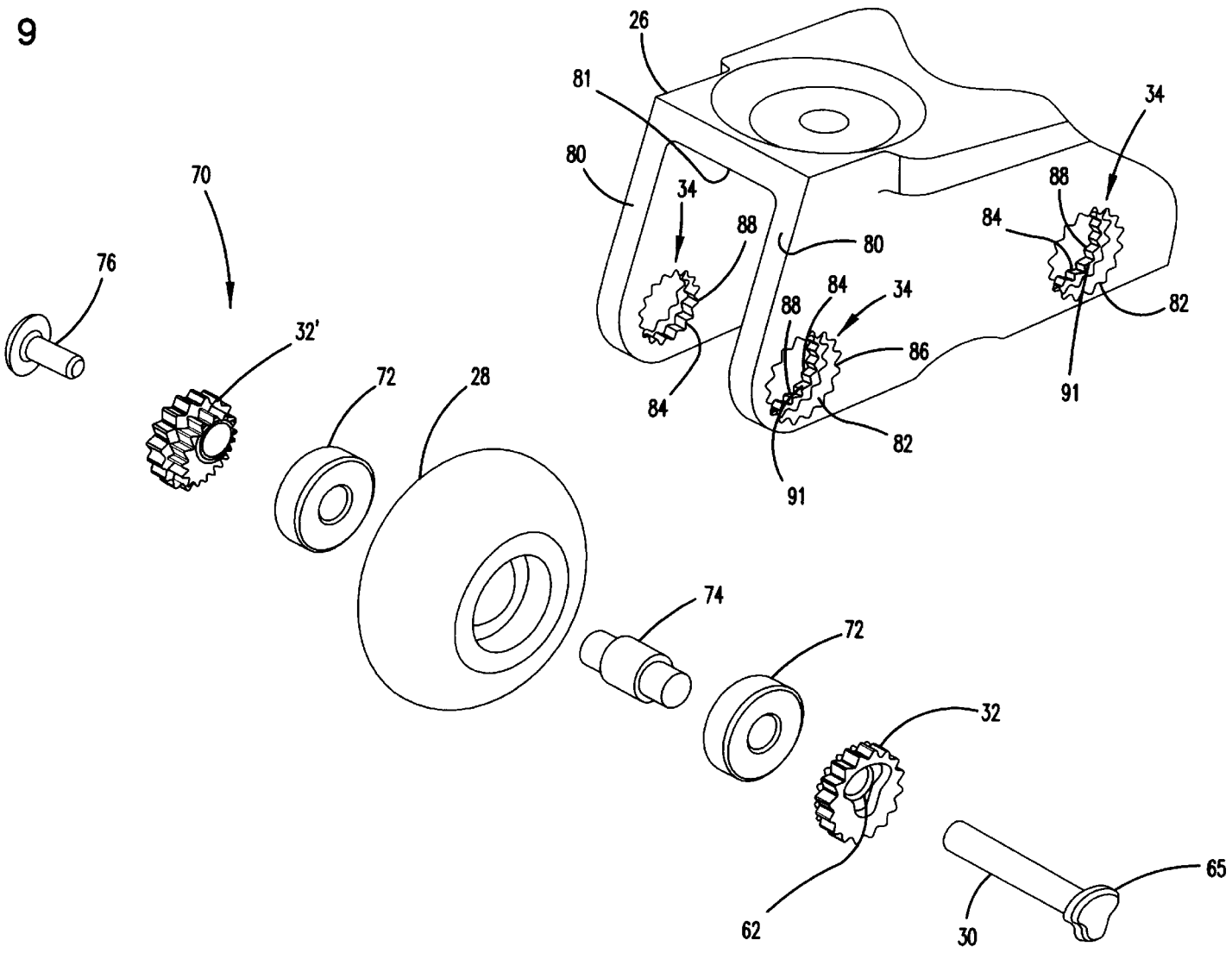
FIG. 9 is an exploded view of an exemplary mounting configuration for rotatably securing an in-line skate wheel to an in-line skate frame, the assembly includes eccentric spacers constructed in accordance with the principles of the present invention.

FIG. 9 shows an exploded view of an exemplary mounting assembly 70 suitable for rotatably connecting one of the wheels 28 to the frame 26. Generally, the assembly 70 includes the axle 30, the eccentric spacer 32, a bearing 72, a bearing spacer 74, one of the wheels 28, another bearing 72, a second eccentric spacer 32', and an axle screw/bolt 76. The eccentric spacers 32 and 32' have substantially the same configuration previously described in the specification. The only difference between the spacers 32 and 32' is that the spacer 32 includes the non-circular recess 62 for receiving the non-circular axle head 65, while the eccentric spacer 32' defines a circular recess 67 (shown in FIG. 10) for receiving a circular head 78 of the axle screw 76. It is preferred for at least one of the axle screw 76 and the axle 30 to have a circular head that fits within a circular recess defined by one of the eccentric spacers 32 and 32'. This is preferred because the circular configuration allows the axle screw 76 and the axle 30 to be tightened relative to one another when the wheel 28 is connected to the frame 26.

As shown in FIG. 9, the frame 26 includes two spaced-apart rails 80 defining a channel 81 sized for receiving the wheels 28. The rails 80 define the spacer openings 34 for mounting the eccentric spacers 32 and 32' on the frame 26. Each spacer opening 34 includes an increased-diameter portion 82 and a reduced-diameter portion 84. The increased diameter portion 82 of each spacer opening 34 defines a plurality of circumferential outer notches 86 sized for receiving the first projections 48 of the eccentric spacers 32 and 32'. Similarly, the reduced-diameter portion 84 of each spacer opening 34 defines a plurality of circumferential inner notches 88 arranged and configured for receiving the second projections 50 of the eccentric spacers 32 and 32'. A retaining lip 91 is formed between the increased-diameter portion 82 and the reduced-diameter portion 84 of each spacer opening 34.

The mounting assembly 70 is assembled by first inserting the bearing spacer 74 within the wheel 28, and then inserting the bearings 72 on opposite sides of the wheel 28. Next, the eccentric spacers 32 are inserted in the eccentric spacer openings 34. Specifically, the eccentric spacers 32 and 32' are inserted in the spacer openings 34 from the outside of the frame 26 and are pushed into the spacer openings 34 until their retaining shoulders 46 engage the retaining lips 91 of the spacer openings 34. Once the eccentric spacers 32 are positioned within the spacer openings 34 of the frame 26, the wheel 28 is positioned within the channel 81 defined by the rails 80. The position of the wheel 28 between the rails 80 is adjusted such that the axis of rotation of the wheel 28 is co-axial with respect to the eccentric axle openings 38 of the eccentric spacers 32. The axle 30 is then inserted through the spacers 32 and 32', the bearings 72, and the spacer 74. Finally, the axle screw 76 is threaded into the axle 30 and tightened such that the assembly 70 is securely fastened to the frame 26.

Figure 10:
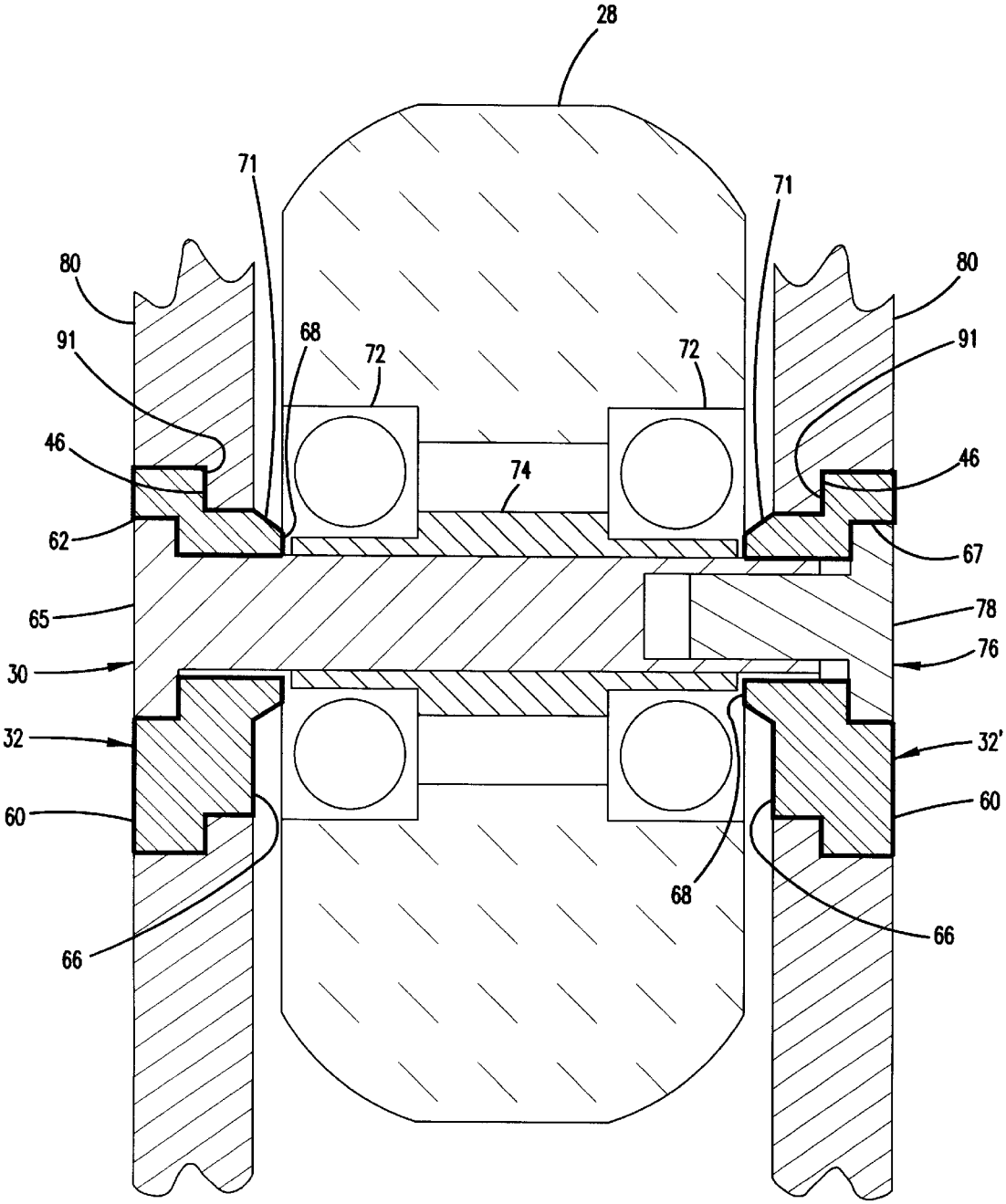
FIG. 10 is a cross-sectional view illustrating the mounting assembly of FIG. 2 as assembled with the in-line skate frame.

FIG. 10 is a cross-sectional view illustrating the mounting assembly 70 as assembled with the frame 26. As shown in FIG. 10, the outer surfaces 60 of the eccentric spacers 32 and 32' are flush with the outer sides of the rails 80. Also, the planar inner surfaces 66 of the eccentric spacers 32 and 32' are substantially flush with the inner sides of the rails 80. Additionally, the annular portions 71 of the eccentric spacers 32 and 32' project between the rails 80 of the frame 26 such that the innermost surfaces 68 engage the bearings 72. Furthermore, the retaining shoulders 46 of the eccentric spacers 32 and 32' engage the retaining lips 91 of the spacer openings 34 to prevent the spacers 32 and 32' from being pulled through the rails 80. Finally, the axle head 65 is seated within the non-circular recess 62 of the eccentric spacer 32, and the circular head 78 of the axle screw 76 is seated within the circular recess 67 of the eccentric spacer 32'.

If it is desired to change the axle 30 position to accommodate a different sized wheel, the axle 30 is removed from the frame 26, thereby enabling the eccentric spacers 32 and 32' to be removed from their corresponding spacer openings 34. Once the eccentric spacers 32 and 32' are removed from the spacer openings 34, the eccentric spacers 32 and 32' can be rotated to any one of 16 different axle positions. The 16 positions allow the eccentric axle openings 38 to be moved upward, downward, forward, or backward relative to the frame 26. The versatility provided by the eccentric spacers 32 and 32' allows a user to precisely adjust the axle location in accordance with the user's needs. For example, to minimize the profile of the frame, the axle can be set such that a given wheel has a small clearance with respect to the frame 26. Additionally, a user can precisely set a desired amount of rockering between the wheels 28. furthermore, the spacers 32 and 32' allow precise spacing to be set between the tandemly arranged wheels 28.

Figure 11:
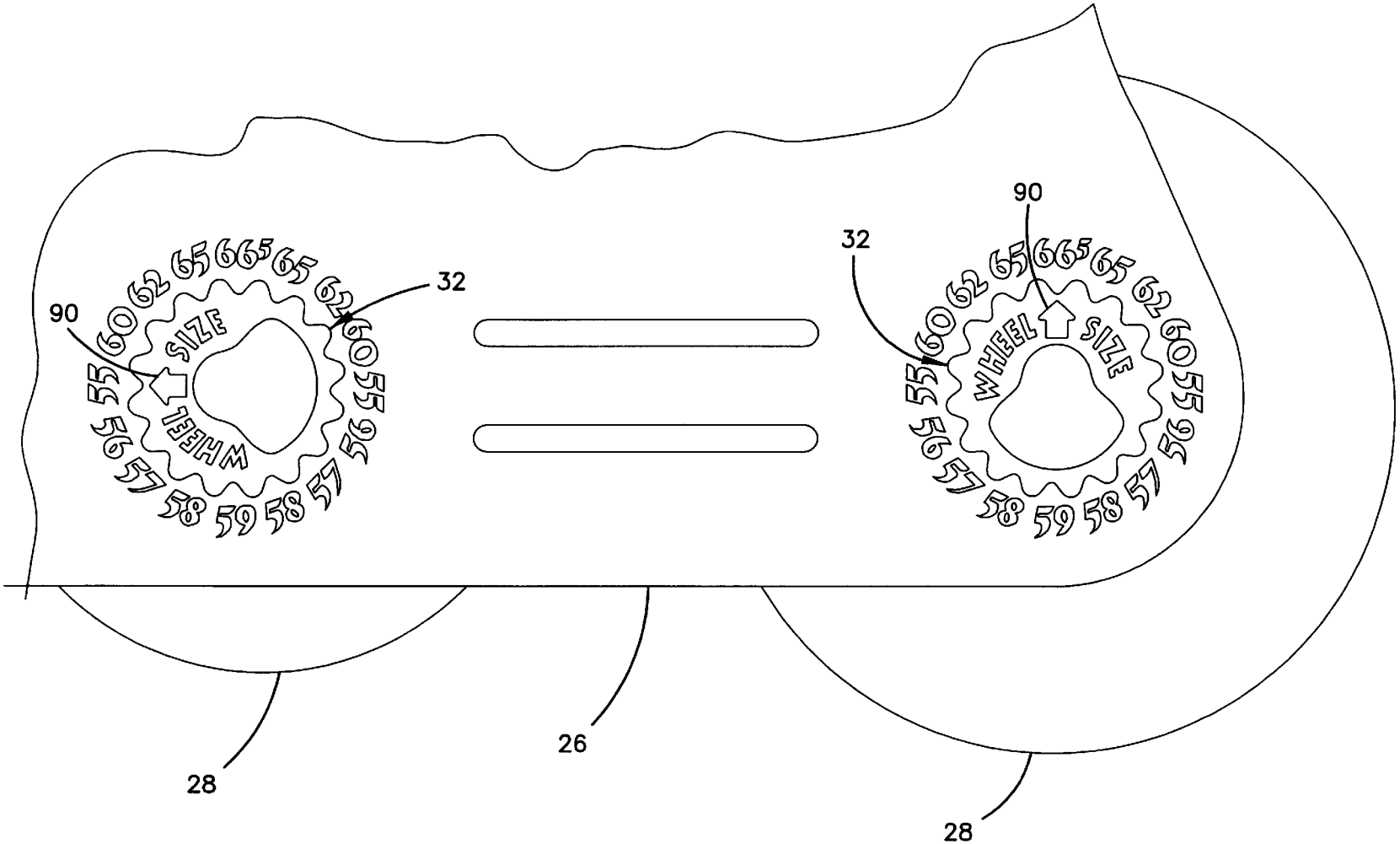
FIG. 11 is an enlarged view of a portion of the in-line skate of FIG. 1.

Referring to FIG. 11, to assist a user in finding the appropriate axle position, each eccentric spacer 32 includes a position arrow 90 on it outer face. The position arrow 90 is designed to work in combination with different wheel sizes that correspond with each of the 16 positions. The wheel sizes corresponding with the different positions are posted on the frame 26 around the spacer receiving openings 34. By orienting the spacer 32 or 32' such that the arrow 90 points at a given wheel size, the recommended minimum spacing between the wheel and the frame is achieved. For example, if a 55 millimeter wheel is desired to be mounted, the arrow 90 would be set to point toward the 55 millimeter label. In contrast, if a 66.5 millimeter wheel is desired to be mounted, the arrow 90 would be set to point toward the 66.5 millimeter label.

With regard to the foregoing description, it is to be understood that changes may be made in detail, especially in matters of the shape, size, and arrangement of the parts without departing from the scope of the present invention. For example, the depicted shapes of the projections and axle head recesses can be modified from those explicitly shown without departing from the scope of the present invention. It is intended that the specification and depicted embodiment be considered exemplary only, with a true scope and spirit of the invention being indicated by the broad meaning of the following claims.

What is claimed is:

1. A spacer for an in-line skate comprising:

a spacer member having a generally circular main body defining an eccentric axle opening extending axially through the main body, the spacer member also including a plurality of projections that project radially outward from the main body of the spacer member;

the main body of the spacer member including co-axially aligned first and second portions, the first portion having a larger diameter than the second portion such that a shoulder is formed between the first and second portions; and the projections including a first plurality of projections projecting radially outward from the first portion, and a second plurality of projections projecting radially outward from the second portion.

2. The spacer of claim 1, wherein the first plurality of projections are uniformly spaced about a circumference of the first portion of the main body, and the second plurality of projections are uniformly spaced about a circumference of the second portion of the main body.

3. The spacer of claim 1, wherein each projection has a generally triangular shape with a rounded apex.

4. The spacer of claim 1, wherein the spacer member main body defines a recess arranged and configured for receiving a head of an axle that is inserted through the axle opening of the spacer member main body, the recess also being sized and shaped to prevent the axle from rotating relative to the spacer member.

5. The spacer of claim 4, wherein the recess is generally bell-shaped.

6. The spacer of claim 1, wherein the first and second pluralities of projections are staggered relative to one another.

7. The spacer of claim 1, wherein the spacer member further comprises an annular portion projecting axially outward from the second portion of the main body portion.

8. The spacer of claim 7, wherein the annular portion is concentric with the axle opening.

9. The spacer of claim 8, wherein the annular portion is chamfered.

10. The spacer of claim 1, wherein the first and second pluralities of projections are arranged in generally sprocket-shaped configurations.

11. An in-line skate comprising:

a boot having a sole;

a frame connected to the sole of the boot, the frame including two spaced-apart rails defining a channel thereinbetween;

a plurality of wheels aligned in tandem within the channel of the frame;

a plurality of axles for rotatably connecting the wheels to the frame; and a plurality of eccentric spacers positionable within spacer openings defined by the rails of the frame, each eccentric spacer including a generally circular main body defining an eccentric axle opening for receiving one of the axles, each eccentric spacer also including a plurality of projections that project radially outward from the main portion of each eccentric spacer;

the main body of each spacer including co-axially aligned first and second portions, the first portion having a larger diameter than the second portion such that a shoulder is formed between the first and second portions; and the spacer openings defined by the rails including a plurality of circumferential notches arranged and configured for receiving the projections of the eccentric spacers, and each spacer opening also including a reduced-diameter portion sized for receiving the second portion of the main body of each spacer, and an increased-diameter portion sized for receiving the first portion of the main body of each spacer.

12. The skate of claim 11, wherein the projections are uniformly spaced about a circumference of the main body of each spacer.

13. The skate of claim 11, wherein each projection has a generally triangular shape with a rounded apex.

14. The skate of claim 11, wherein the main body of at least one of the eccentric spacers defines a recess arranged and configured for receiving a head of one of the axles, the recess cooperating with the head of the axle to prevent the axle from rotating relative to the spacer.

15. The skate of claim 14, wherein the recess is generally bell-shaped.

16. The skate of claim 11, wherein the projections include a first plurality of projections projecting radially outward from the first portion, and a second plurality of projections projecting radially outward from the second portion.

17. The skate of claim 16, wherein the first and second pluralities of projections are staggered relative to one another.

18. The skate of claim 11, wherein each spacer further comprises an annular portion projecting between the rails for engaging a bearing of one of the wheels.

19. The skate of claim 11, wherein the circumferential notches include first notches defined by the increased-diameter portion of each spacer opening, and second notches defined by the reduced-diameter portion of each spacer opening, and the projections of each spacer include a first plurality of projections projecting radially outward from the first portion of each spacer, and a second plurality of projections projecting radially outward from the second portion of each spacer, wherein the first plurality of projections fit within the first notches, and the second plurality of projections fit within the second notches.

20. The skate of claim 19, wherein the first plurality of projections of each spacer are staggered with respect to the second plurality of projections of each spacer.

21. A spacer for an in-line skate comprising:

a spacer member having a generally circular main body defining an eccentric axle opening extending axially through the main body, the spacer member also including a plurality of projections that project radially outward from the main body of the spacer member; and the spacer member main body defining a generally bell-shaped recess arranged and configured for receiving a head of an axle that is inserted through the axle opening of the spacer member main body, the bell-shaped recess being sized and shaped to prevent the axle from rotating relative to the spacer member.

22. An in-line skate comprising:

a boot having a sole;

a frame connected to the sole of the boot, the frame including two spaced-apart rails defining a channel thereinbetween;

a plurality of wheels aligned in tandem within the channel of the frame;

a plurality of axles for rotatably connecting the wheels to the frame, the axles having generally bell-shaped heads;

a plurality of eccentric spacers positionable within spacer openings defined by the rails of the frame, each eccentric spacer including a generally circular main body defining an eccentric axle opening for receiving one of the axles, each eccentric spacer also including a plurality of projections that project radially outward from the main portion of each eccentric spacer; and at least some of the eccentric spacers defining generally bell-shaped recesses for receiving the bell-shaped heads of the axles.

* * * * *